US009970320B2

(12) United States Patent
De Sousa et al.

(10) Patent No.: US 9,970,320 B2
(45) Date of Patent: May 15, 2018

(54) EXHAUST HOUSING HUB FOR A TURBOMACHINE

(71) Applicant: SNECMA, Paris (FR)

(72) Inventors: Mario Cesar De Sousa, Cesson (FR); Frederic Noel, Yerres (FR); Nicolas Pommier, Acheres (FR); Olivier Renon, Courpalay (FR)

(73) Assignee: SNECMA, Paris (FR)

( * ) Notice: Subject to any disclaimer, the term of this patent is extended or adjusted under 35 U.S.C. 154(b) by 275 days.

(21) Appl. No.: 14/439,998

(22) PCT Filed: Oct. 22, 2013

(86) PCT No.: PCT/FR2013/052519

§ 371 (c)(1),
(2) Date: Apr. 30, 2015

(87) PCT Pub. No.: WO2014/068220

PCT Pub. Date: May 8, 2014

(65) Prior Publication Data

US 2015/0285098 A1 Oct. 8, 2015

(30) Foreign Application Priority Data

Oct. 31, 2012 (FR) ..... 12 60439

(51) Int. Cl.

| | |
|---|---|
| ***F01D 25/16*** | (2006.01) |
| ***F01D 25/24*** | (2006.01) |
| ***F01D 25/28*** | (2006.01) |
| ***F01D 9/04*** | (2006.01) |

(52) U.S. Cl.

CPC ..... *F01D 25/162* (2013.01); *F01D 9/04* (2013.01); *F01D 25/243* (2013.01); *F01D 25/28* (2013.01)

(58) Field of Classification Search

CPC ..... F01D 9/04; F01D 25/162; F01D 25/24; F01D 25/243; F01D 25/246

See application file for complete search history.

(56) References Cited

U.S. PATENT DOCUMENTS 6,672,966 B2 * 1/2004 Muju ..... F16D 1/112 415/124.2
7,371,046 B2 * 5/2008 Lee ..... F01D 5/143 415/191

(Continued)

FOREIGN PATENT DOCUMENTS

| | | |
|---|---|---|
| EP | 1 262 636 | 12/2002 |
| EP | 1 262 636 A3 | 12/2002 |
| JP | 09 324699 | 12/1997 |
| JP | 9-324699 A | 12/1997 |

OTHER PUBLICATIONS

University of Washington, Stress Concetration and Stress Raisers, Apr. 25, 2006, Chapter 6, pp. 6.1-6.8.*

(Continued)

*Primary Examiner* — Richard Edgar
*Assistant Examiner* — John S Hunter
(74) *Attorney, Agent, or Firm* — Oblon, McClelland, Maier & Neustadt, L.L.P.

(57) ABSTRACT

An exhaust housing hub of a turbomachine, including a connecting wall and an inner channel wall, the connecting wall connecting the inner channel wall to inner attachment flanges, wherein a radial section of the connecting wall is curved and can be formed, as required, as a single component with the inner channel wall, the hub also including a series of ribs extending radially between the connecting wall and the inner channel wall.

12 Claims, 3 Drawing Sheets

(56) References Cited

U.S. PATENT DOCUMENTS

| | | | | |
|---|---|---|---|---|
| 7,770,378 | B2 | 8/2010 | Eleftheriou et al. | |
| 2002/0182058 | A1 | 12/2002 | Darnell et al. | |
| 2007/0241257 | A1 | 10/2007 | Eleftheriou et al. | |
| 2007/0280819 | A1 | 12/2007 | Eleftheriou et al. | |
| 2008/0010970 | A1 | 1/2008 | Eleftheriou et al. | |
| 2008/0010996 | A1 | 1/2008 | Eleftheriou et al. | |
| 2008/0014083 | A1 | 1/2008 | Eleftheriou et al. | |
| 2008/0014084 | A1 | 1/2008 | Eleftheriou et al. | |
| 2009/0101787 | A1 | 4/2009 | Dierberger | |
| 2010/0275614 | A1 | 11/2010 | Fontaine et al. | |
| 2013/0175327 | A1 | 7/2013 | Fontaine et al. | |
| 2014/0341730 | A1* | 11/2014 | Kullenberg | F01D 25/28 415/211.2 |
| 2015/0132110 | A1* | 5/2015 | Mountz | F01D 25/162 415/144 |

OTHER PUBLICATIONS

Wayback Machine, Printout Showing Date for NPL Ref U.*

French Preliminary Search Report dated Jan. 30, 2013 in Patent Application No. 1260439 (with English translation of categories of cited documents).

International Search Report dated Jan. 21, 2014 in PCT/FR2013/052519 (with English translation of categories of cited documents and International Search Report English translation previously filed Apr. 30, 2015).

International Search Report dated Jan. 21, 2014 in PCT/FR13/052519 Filed Oct. 22, 2013.

* cited by examiner

EXHAUST HOUSING HUB FOR A TURBOMACHINE

FIELD OF THE INVENTION

The invention relates generally to the field of turbomachines, and more particularly to exhaust housings for turbomachines.

TECHNOLOGICAL BACKGROUND

A turbomachine has a principal direction extending along a longitudinal axis, and typically comprises, from upstream to downstream in the gas flow direction, a fan, a low-pressure compressor, a high-pressure compressor, a combustion chamber, a high-pressure turbine and a low-pressure turbine including in particular an exhaust housing. The exhaust housing contributes to delimit the primary channel of fluid (or gas flow) passing through the turbomachine, and ensures, through the bearing supports, the concentricity between the rotor and the stator of the turbomachine, as well as the connection of the downstream end of the motor to the nacelle. The exhaust housing is therefore one of the principal structural parts subject to very high heat levels, and wherein pass extreme unbalanced loads.

This exhaust housing includes conventionally:

- a hub, centered on the axis of the turbomachine,
- an external frame, coaxial with the hub, and
- a set of arms, or sleeves, connecting the hub and the external frame.

The hub generally comprises a flange (with very diverse shapes) connected, at an internal part, to one (or to some) bearing support(s) intended to center the rotor on the axis of the turbomachine, and at an external part, to the exit cone (or exhaust cone, or "plug"), via an attachment strut. This flange is moreover covered with a sheet-metal part delimiting the channel, in its lower portion, and having openings adapted for receiving the arms.

These hubs are traditionally of a shape that is not or is only slightly deformable (called Y or H, among others), and this type of architecture induces strong forces in the rest of the housing, for example, at the intersection between the leading edge of the arms and the flange(s). Moreover, when the turbomachine is operating, the exhaust housing is subject to high temperatures and to very high thermal transient gradients. This is particularly the case of the hub, between its lower portion, that is at its bearing support attachment struts, and its upper portion, that is at its duct plate. Finally, the hub must be capable of supporting, in terms of ultimate strength, the forces and moments resulting from the loss of a blade.

It is therefore necessary that the hub be sufficiently rigid. However, it must also be capable of mechanically accepting a sufficient internal deformation (or, if it is associated to tangential arms, a free rotation about the axis of the housing), to be able to ensure the overall lifetime of the exhaust housing.

Considering the rigidity of the hub, loads due to strong transient thermal gradients (average and/or local temperature excursions) are displaced toward the outer frame and particularly to the leading and trailing edges of the arms. However, in making the exhaust housing hub more flexible to distribute the deformations and to limit the forces applied to the different parts which constitute it, it is made more sensitive to its outside environment in the turbomachine, in particular in vibration and under extreme loads. It is therefore necessary to maintain a minimum rigidity so that it remains stable and robust even in the case of a change in mechanical and vibratory constraints, even in case of a change in mechanical and vibratory forces undergone by the turbomachine (modification of thermal fields, of extreme loads, etc.).

It is therefore sought to propose a hub which is at the same time capable of compensating the thermal dilations and to homogenize the radial deformations over 360° at the intersection of the inner channel wall and the leading edge of the arms, without however impeding the deformation of the rest of the exhaust housing, so as to prevent the premature decay thereof.

Solutions proposed at present are not generally applicable to all types of turbomachines, because they often require the addition of parts, which represent both an additional cost and a non-negligible mass, are too complex to be implemented, or are too voluminous.

For example, in order to compensate the relative dilations of the different parts of the housing, it has been proposed to tangentially rather than radially integrate the arms between the hub and the outer frame. In this manner, during the relative dilations of the parts due to thermal gradients in the exhaust housing, the hub turns with respect to the outer frame, which allows it to avoid punching by the arms and the risk of perforation of the external frame by different relative deformations between two or several adjacent parts. However, in certain exhaust housings, the distance between the hub and the outer frame is very short, which limits the possibility of implementing such tangential arms. This solution can therefore not be considered for all types of turbomachines.

It has also been proposed to make the duct plate and the flange in two distinct pieces, so as to allow their relative movement during thermal dilation of the operating parts and to thus reduce the forces applied to them and at their intersection with the arms. However, the separation of the duct plate and the hub involves the use of additional fixing means, such as flanges and nuts, which increases the size of the hub and thus increases the overall weight and cost of the housing. Significant leakage of the flow in the interstices may further result from this embodiment. It remains therefore a need for some exhaust housings to form the flange and the duct plate integrally, that is to say in single piece.

There has also been proposed, in document JP 09 324699, a hub of a housing of a turbomachine including an inner channel wall, from which extend vanes and a connecting wall with a curved shape intended to connect the inner channel wall to an internal attachment strut. However, the curved shape proposed by this document forms an obstacle to flow likely to cause local aerodynamic perturbations. Moreover, the concavity in the central part of the connecting wall forms a cavity likely to generate parasitic thermal gradients that are very harmful at these temperature levels.

SUMMARY OF THE INVENTION

One objective of the invention is therefore to propose a hub as well as a housing capable of being adapted to a greater number of turbomachines, which makes it possible to improve the lifetime of the housing, while still being capable of enduring the external vibratory loads (including for example the loads induced by the loss of a blade), that is the loads arising from the housing interfaces (such as the bearings, the exit cone, as well as all the parts adjacent to the exhaust housing) as well as the very large thermal gradients which can be attained during operation in this type of housing, and to respond to the objectives of bulkiness, of mass and of flexibility, while still being simple to realize with a moderate cost.

To this end, the invention proposes an exhaust housing hub of a turbomachine, including internal attachment flanges adapted to be attached to a bearing support, a wall, an annular connecting wall and an annular inner channel wall, the connecting wall connecting the inner channel wall to the inner attachment flanges, wherein a radial section of the connecting wall is rounded, the hub further including a series of ribs extending radially between the connecting wall and the inner channel wall.

The hub then shows a sufficient flexibility to allow it to support the very large thermal gradients in the exhaust housing and to allow the exhaust housing to generally "breath" so as not to constrain too much the dilation of the outer frame. Moreover, the ribs, which for locally optimized reinforcements, make it possible to endure the endure loads in the case of extreme forces and moments generated at the boundaries of the hub by the possible loss of a fan blade. Finally, the hub thus made is dimensionally adapted to the dynamic loads to which the exhaust housing is subject, while observing specifications of mass, and can be obtained by a single foundry operation, without other mechanical or welding operations.

Certain preferred but non-limiting features of the housing hub are the following:

- the connecting wall, the inner channel wall and the inner attachment flanges are formed integrally,
- the curve of the radial section of the connecting wall has no inflection point,
- the connecting wall has a concavity oriented toward the upstream part of the housing,
- the radial section of the connecting wall includes inner attachment flanges near the inner channel wall, a first portion, substantially straight, extending radially in the direction of the downstream portion of the hub and a second portion, with a curved shape, the concavity whereof is oriented upstream of the hub,
- an upstream end (with respect to the gas flow direction) of the connecting wall, located at the junction between the connecting wall and the inner channel wall, has a tangent substantially parallel to the inner channel wall,
- the hub further includes excess thickness at the intersection between the inner channel wall and the connecting wall,
- the hub further includes the first portions of the arms, extending from the inner channel wall and formed integrally therewith, and adapted to be attached to second portions of complementary arms of the housing,
- the excess thickness extends in line with a leading edge of the first portions of the arms, and
- the hub further includes an annular ridge extending radially from the inner channel wall downstream of the series of ribs.

According to a second aspect, the invention also proposes an exhaust housing for a turbomachine, having a principal direction extending according to a longitudinal axis and including

- a hub as described above, centered on the longitudinal axis,
- an external frame, coaxial with the hub, and
- a set of arms connecting the inner channel wall to the outside frame.

According to a third aspect, the invention proposes a turbomachine including such a housing.

BRIEF DESCRIPTION OF THE DRAWINGS

Other features, goals and advantages of the present invention will be better revealed from the detailed description hereafter, made with reference to the appended figures given by way of non-limiting examples and in which.

DETAILED DESCRIPTION OF AN EMBODIMENT

Figure 1:
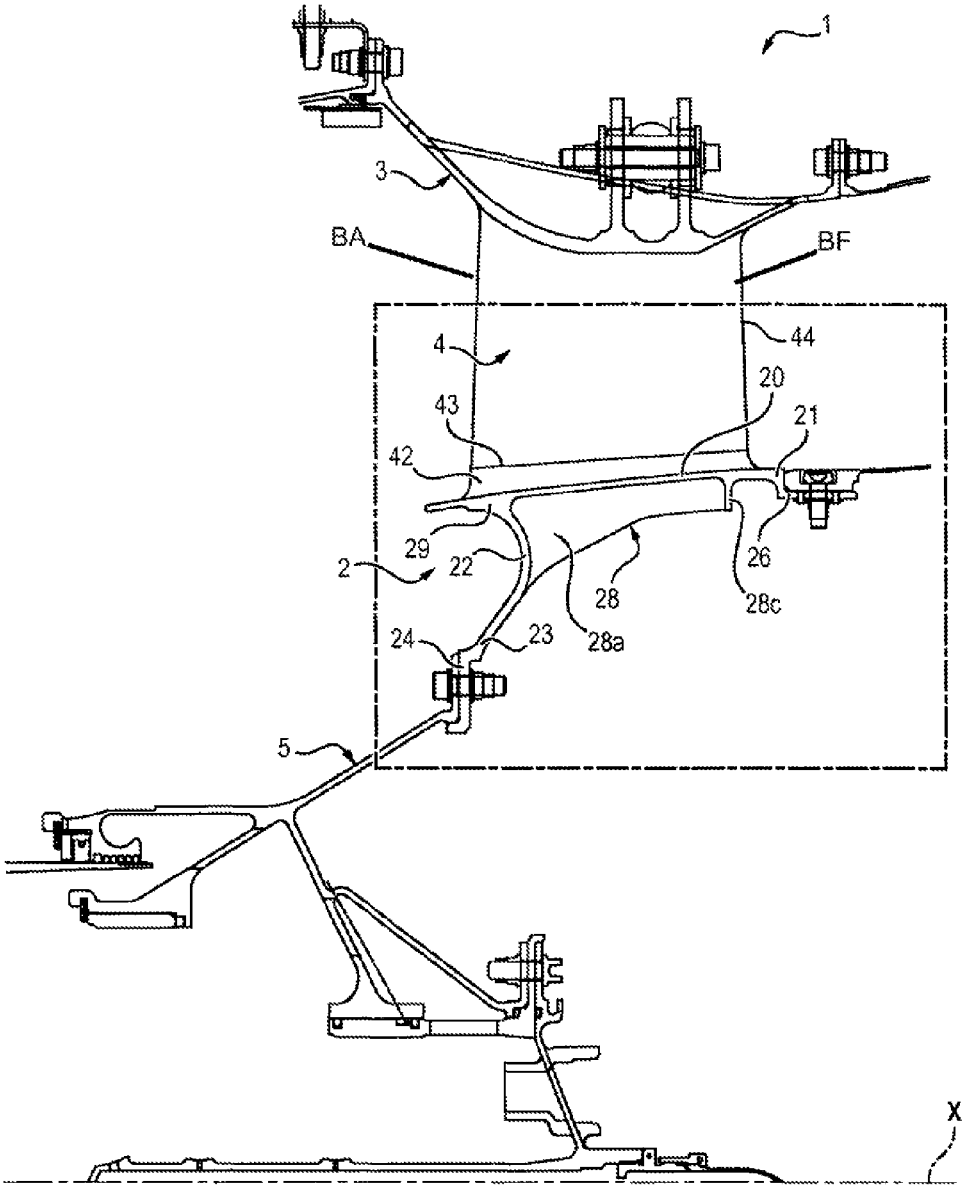
FIG. 1 is a partial section view of an example of an exhaust housing of a turbomachine conforming to this invention.

Hereafter, the invention will be described by its application to an exhaust housing of a turbomachine. This is however not limiting, to the extent that it applies to any annular housing subjected to thermal gradients and needing to be capable of supporting large loads.

An exhaust housing 1 of a turbomachine conforming to the invention has a principal direction extending along a longitudinal axis X and includes:

- a hub 2, centered on the axis X of the exhaust housing 1,
- an external frame 3, coaxial with the hub 2, and
- a set of arms 4, connecting the hub 2 and the outside frame 3.

The hub 2 is of a generally annular shape and is adapted to be connected internally to bearing supports 5 via inner attachment flanges 24, and downstream, at an outer part, to an exhaust exit cone through external attachment flanges 26.

The hub 2 includes an annular inner channel wall 20, positioned facing the outer frame 3, adapted to delimit the inner gas flow channel, from which extends radially inward an annular connecting wall 22. As illustrated in FIG. 1, the intersection between the connecting wall 22 and the inner channel wall 20 can be in line with the leading edge BA of the arms 4 of the exhaust housing 1, and include an excess thickness provided so as to homogenize in this area the radial displacements over 360° and limit the creation of over-loads.

The inner attachment flanges 24 are formed in one piece with the connecting wall 22, and extend from its free end 23, while the external attachment flanges 26 are formed integrally with the inner channel wall 20 and extend from its free end 21.

A radial section (that is in a plane normal to the longitudinal axis X) of the connecting wall 22 is curved and has the shape of a lyre or a comma, which allow it to make the hub 2 sufficiently flexible to follow the dilation of the arms 4 and of the outer frame 3, but sufficiently rigid from a thermal and mechanical standpoint at the intersection between the inner channel wall 20 and the leading edge of the arms 4 to homogenize the radial deformations over 360° in the inner channel wall 20. The concavity of the radial section of the connecting wall 22 is oriented upstream, with no inflection point, so as to be able to deform (by opening and closing) and compensate the relative dilations caused by the thermal gradients of the hub 2 with respect to the outside frame 3 in the exhaust housing 1. The connecting wall 22 can in fact deform in bending under the influence of the various different deformations, thanks to its shape which makes it more flexible.

Figure 4:
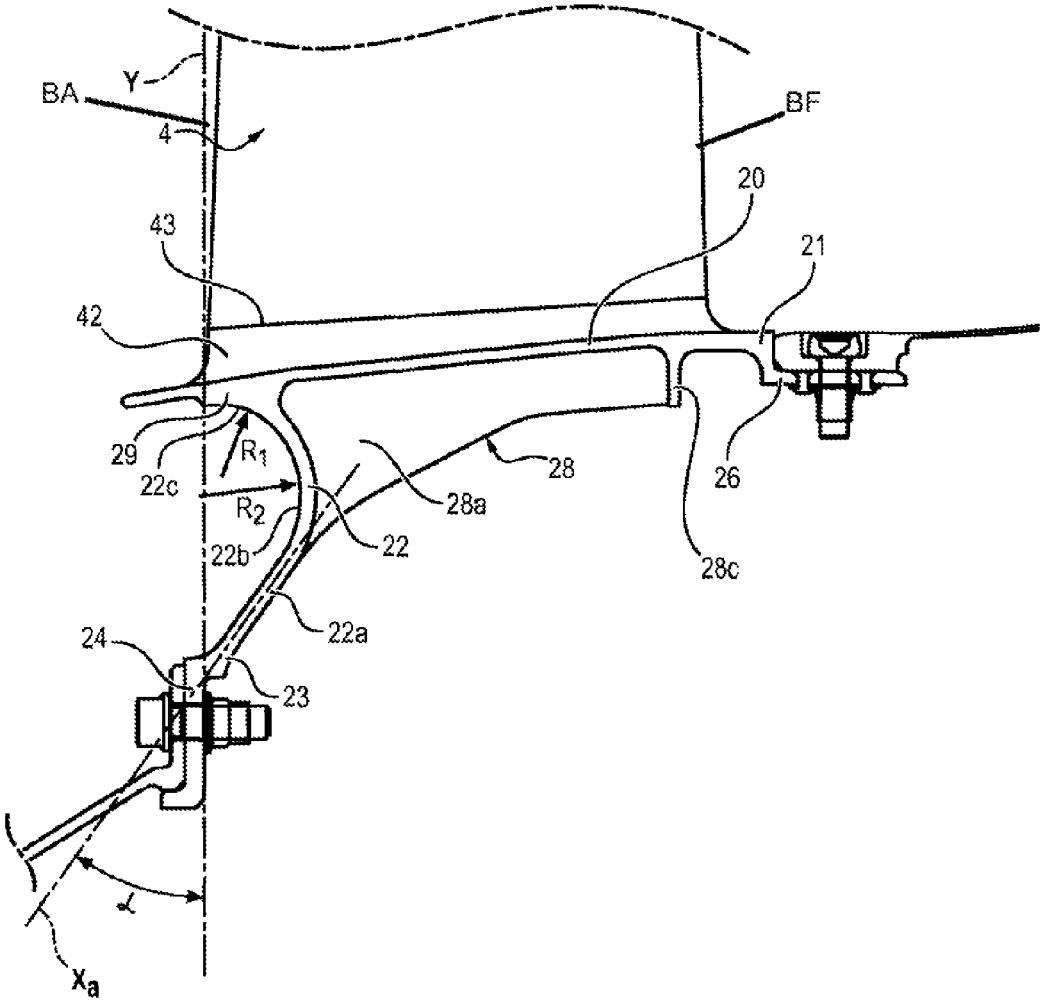
FIG. 4 is a detail view of FIG. 1.

For example, as illustrated for example in FIG. 4, the radial section of the connecting wall 22 can include internal attachment flanges 24 to the inner channel wall 20:

- a first portion 22*a*, substantially straight, extending radially in the direction of the outer attachment flange 26. This first portion thus has a radial section generally inclined downstream (in the direction of gas motion in the exhaust housing) at an angle α comprised between 20° and 60°, preferably on the order of 40°. Here, the angle α is measured between the axis Xa along which extends the first portion 22*a* of the connecting wall, and the axis Y substantially perpendicular to the axis of the exhaust housing passing by the leading edge BA of the arms 4;
- a second portion 22*b* with a curved shape, the concavity of which is oriented upstream of the hub 2. For example, the radial section of the second portion 2*b* can have a radius R2 comprised between 15 mm and 30 mm, preferably between 15 mm and 20 mm, for example on the order of 18.5 mm, and
- a third portion 22*c*, with a curved shape, the concavity whereof is oriented upstream of the hub and the upstream end whereof is located at the junction between the connecting wall 22 and the inner channel wall 20. At this second upstream end, the third portion 22*c* has a tangent substantially parallel to the inner channel wall 20, so as to form a softened junction not perturbing the flow in the exhaust housing. The third portion 22*c* and the inner channel wall 20 therefore have a point of tangency. For example, the section of the third portion has a radius R1 comprised between 5 mm and 20 mm, preferably between 10 mm and 15 mm, for example on the order of 12 mm.

The second portion 22*b* and the third portion 22*c* form together the concave portion of the connecting wall 22.

The first portion 22*a* on the one hand, and the second portion 22*b* and the third portion 22*c* on the other hand, have a curved length that is substantially equal. Moreover, the intersection between the connecting wall 22 and the internal channel wall 20 is generally vertically above the free end 23 of the connecting wall 22, that is in the same radial plane passing through the axis X of the housing 1.

The connecting wall 22 can be relatively thin. For example, the thickness of the connecting wall can be on the order of thickness of the inner channel wall, that is between 1 mm and 3 mm.

During the different loads undergone by the hub 2, the hub 2 can therefore deform itself at the level of the connecting wall 22 which opens and bends (its curvature then being greater than at rest) or extends and tends to separate the inner channel wall 20 from the inner attachment flanges 24, thus avoiding damaging the remainder of the hub 2 or the exhaust housing 1.

The inner channel wall 20 can be formed integrally with the connecting wall 22, that is in a single piece, so as to eliminate the risks of leakage and to reduce the bulkiness and the global mass of the hub 2. It is in addition relatively thin so as to optimize the overall mass of the hub 2, except at the leading edge BA where, as will be seen hereafter, the inner channel wall 20 can have an annular excess thickness 29 so as to homogenize the radial deformations over 360°.

The inner channel wall 20 and the connecting wall 22 are preferably obtained by casting in a conventional material for the hub 2, that is a material capable of resisting, during long use, the very high temperatures to which the hub 2 is subjected (on the order of 650° C. to 700° C.), while still tolerating the low-cycle and vibratory fatigue and showing good resistance to load. For example, the walls 20 and 22 can be made of a nickel-chrome alloy.

The arms 4 of the exhaust housing 1 extend between the inner channel wall 20 of the hub 2 and the outside frame 3. For feasibility questions, the arms 4 are preferably accomplished in two parts, a first part 42, forming the base of the arms 4, extending radially from the internal channel wall 20, and a second part 44, forming the body of the walls 4, extending radially from the outer frame 3.

The bases 42 are preferably realized integrally with the inner channel wall 20 of the hub 2, while the bodies 44 can be formed integrally with the frame 3, for example by casting. The two parts of the wall, 42, 44 are then positioned facing one another so as to be attached together, for example by welding along a welding plane 43, so as to connect the hub 2 and the outer frame 3.

According to one form of realization, the feet 42 extend over a height less than or equal to a quarter of the total height of the arms 4. The de-molding of the hub 2, formed of a portion of the internal 24 and external 26 attachment flanges, the connecting wall 22, the inner channel wall 20 and the bases 42, can then be made more easily than if the welding plane 43 was more separated from the inner channel wall 20. The bases 42, however, have a non-zero height so as not to interfere, considering the welding plane 43, with the connecting radius of the arms 4 to the inner channel wall 20.

In order to improve performance under load, particularly in extreme loads (loss of a blade, etc.) or of bearings, the inner channel wall 20 of the hub 2 can in addition include ribs 28. The ribs 28 extend preferably between the inner channel wall 20 and the connecting wall 22, facing the walls 4 of the exhaust housing 1. This improves the resistance to deformations of the hub 2, resulting from thermal constraints and from extreme loading.

For example, the hub 2 can include two ribs 28 facing each arm 4 of the exhaust housing 1.

Figure 2:
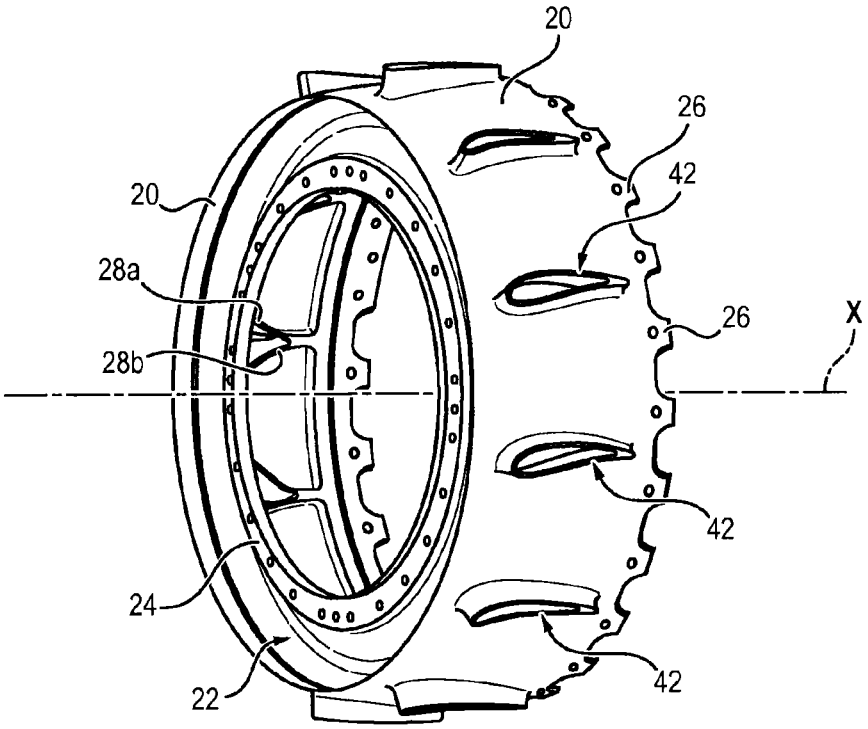
FIG. 2 is a perspective view of an embodiment of a hub 2 conforming to the invention.
Figure 3:
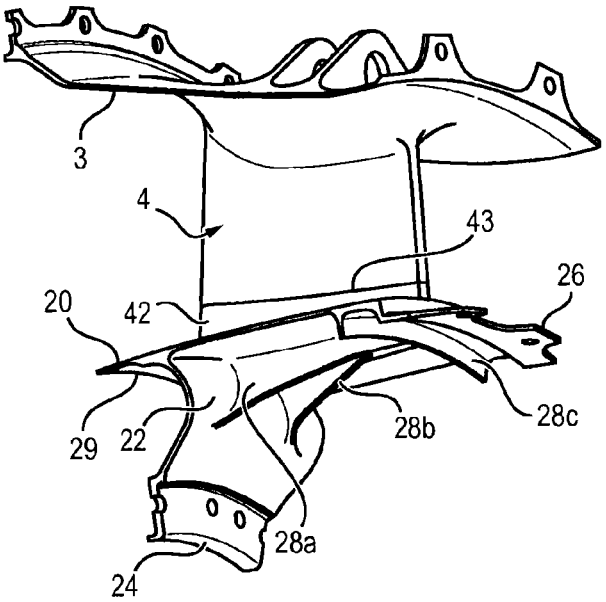
FIG. 3 is a partial perspective view of the example of the exhaust housing of FIG. 1.

The ribs 28 can be formed integrally with the inner channel wall 20 and the connecting wall 22. As illustrated in FIGS. 2 and 3, the ribs can each include two radial ridges 28*a*, 28*b*, positioned in the extension of the upper wall and the lower wall respectively, and which extend parallel t the axis X of the connecting wall 22 toward the downstream end 21 of the inner channel wall 20, up to being in line with the trailing edge BF of the arms 4. The radial ridges 28*a*, 28*b* of the ribs consequently have first a convergent shape from upstream to downstream in the gas flow direction, then join, and are thus capable of better supporting changes imposed by the arms 4 and the bearing support of the hub 2.

The height of the ribs 28 (in the radial direction with respect to axis X) can moreover vary between the upstream end, at the connecting wall 20, and their downstream end, at right angle with the trailing edge BF of the arms 4. Here, the height of the ribs 28 is maximum at the connecting wall 22, then drops in the downstream direction until the ridges 28*a* and 28*b* join each other, where it stabilizes until the downstream end of the ribs 28, as illustrated in FIGS. 2 and 3, so as optimize the overall mass of the hub 2 while still guaranteeing its performance under load with the ribs 28.

Moreover, the hub 2 can in addition include a stiffener 28*c*, making it possible to uniformly distribute radial deformations over 360° downstream of the inner channel wall 20, in the vicinity of the trailing edges BF of the arms 4 and to support the ribs under loads which pass through these ribs. The stiffener 28*c* can in particular be an annular ridge coaxial with the hub 2, extending radially from the inner channel wall 20 at the downstream end of the ribs 28, or at right angle with the trailing edge BF of the arms 4. Here, the stiffener 28*c* extends over a height equal to the height of the downstream end of the ridges 28*a*, 28*b* of the rib 28.

Finally, the hub 2 can also comprise an annular excess thickness 29 at the intersection between its connecting edge 22 and it internal channel wall 20, at right angle with the leading edge BA of the arms 4. This excess thickness 29, which is visible on FIGS. 1 and 3, in fact makes it possible to homogenize the radial deformations over 360° of the inner channel wall 20 despite the thermal constraints or loads to which the exhaust housing 1 is subjected. This excess thickness 29 also makes it possible to locally reinforce the hub 2 and to improve its resistance to loads in the case of extreme forces and moments generated at the boundaries of the hub 2 by the possible loss of a fan blade.

The excess thickness 29 is preferably local and does not extend over all the inner channel wall 20, and remains thin to reduce the overall mass of the hub 2. For example, the excess thickness can have a radial section with a thickness comprised between 4 mm and 8 mm, typically on the order of 5 mm. As seen in the figures, the excess thickness 29 can be positioned at the junction between the connecting wall 22 and the inner channel wall 20, which extends globally along the third portion 22*c* of the connecting wall 22.

The invention claimed is:

1. A hub of an exhaust housing of a turbomachine, said hub comprising:

inner attachment flanges intended to be attached to a bearing support;

an annular connecting wall; and an annular inner channel wall, wherein the annular connecting wall connects the annular inner channel wall to the inner attachment flanges, wherein a radial section of the annular connecting wall includes, from the inner attachment flanges to the annular inner channel wall:

a first portion, straight, extending radially in the direction downstream of the hub; and a second portion with a curved shape, the concavity whereof is oriented upstream of the hub, and wherein the radial section of the annular connecting wall is curved from the first portion to a junction between the annular connecting wall and the annular inner channel wall, wherein a series of ribs extends radially between the second portion of the annular connecting wall and the annular inner channel wall.

2. The hub according to claim 1, wherein the annular connecting wall, the annular inner channel wall, and the inner attachment flanges are formed integrally.

3. The hub according to claim 1, wherein the curvature of the radial section of the annular connecting wall has no inflection point.

4. The hub according to claim 1, wherein the annular connecting wall has a concavity oriented upstream of the housing.

5. The hub according to claim 1, wherein an upstream end of the annular connecting wall, located at the junction between the annular connecting wall and the annular inner channel wall has a tangent parallel to the annular inner channel wall.

6. The hub according to claim 1, further including a thickness at the intersection between the annular inner channel wall and the annular connecting wall.

7. The hub according to claim 6, wherein the thickness extends at a right angle with a radial leading edge of the first portions of arms.

8. The hub according to claim 1, wherein the hub further comprises a first portions of arms, extending from the annular inner channel wall and formed integrally therewith, and intended to be attached to a second portions of arms complementary to the housing.

9. The hub according to claim 1, further including an annular ridge extending radially from the annular inner channel wall downstream of the series of ribs.

10. The hub according to claim 1, wherein the radial section of the annular connecting wall further includes a third portion with a curved shape, the concavity whereof is oriented upstream of the hub, a downstream end of the third portion of the radial section of the annular connecting wall is connected to the second portion of the radial section of the annular connecting wall, and an upstream end of the third portion of the radial section of the annular connecting wall is located at the junction between the annular connecting wall and the annular inner channel wall, wherein the second portion of the radial section of the annular connecting wall and the third portion of the radial section of the annular connecting wall form a concave portion of the annular connecting wall, and wherein a radius of the second portion of the radial section of the annular connecting wall is greater than a radius of the third portion of the radial section of the annular connecting wall.

11. An exhaust housing for a turbomachine, having a principal direction extending along a longitudinal axis and including a hub according to claim 1, centered on the longitudinal axis, an external frame coaxial with the hub, and a set of arms connecting the annular inner channel wall to the outer frame.

12. A turbomachine, comprising: an exhaust housing including a hub, centered on a longitudinal axis of the turbomachine, the hub comprising:

inner attachment flanges intended to be attached to a bearing support;

an annular connecting wall; and an annular inner channel wall, wherein the annular connecting wall connects the annular inner channel wall to the inner attachment flanges, wherein a radial section of the annular connecting wall includes, from the inner attachment flanges to the annular inner channel wall:

a first portion, straight, extending radially in the direction downstream of the hub; and a second portion with a curved shape, the concavity whereof is oriented upstream of the hub, and wherein the radial section of the annular connecting wall is curved from the first portion to a junction between the annular connecting wall and the annular inner channel wall, wherein a series of ribs extends radially between the second portion of the annular connecting wall and the annular inner channel wall;

an external frame coaxial with the hub; and a set of arms connecting the annular inner channel wall to the outer frame.

* * * * *